US008033542B2

(12) United States Patent
Bisone et al.

(10) Patent No.: US 8,033,542 B2
(45) Date of Patent: Oct. 11, 2011

(54) EQUIPMENT FOR STORING IN AN ORDERLY WAY BANKNOTES AND/OR PAPERS AND THE LIKE

(75) Inventors: Dario Bisone, Bollengo (IT); Mauro Martinotti, Bollengo (IT); Mirko Billet, Bollengo (IT); Paolo Donnis, Bollengo (IT)

(73) Assignee: CTS Cashpro S.p.A., Bollengo (IT)

( * ) Notice: Subject to any disclaimer, the term of this patent is extended or adjusted under 35 U.S.C. 154(b) by 261 days.

(21) Appl. No.: 12/278,862

(22) PCT Filed: Feb. 9, 2007

(86) PCT No.: PCT/EP2007/051303

§ 371 (c)(1),
(2), (4) Date: Aug. 8, 2008

(87) PCT Pub. No.: WO2007/090899

PCT Pub. Date: Aug. 16, 2007

(65) Prior Publication Data

US 2009/0184458 A1 Jul. 23, 2009

(30) Foreign Application Priority Data

Feb. 10, 2006 (IT) ..... TO2006A0093

(51) Int. Cl.
*B65H 29/42* (2006.01)

(52) U.S. Cl. ..... 271/179; 414/795.1; 271/180; 271/181; 209/534; 194/206; 194/207; 902/8; 902/13; 902/14; 902/15

(58) Field of Classification Search ..... 271/179, 271/180, 181; 414/795.1; 209/534; 194/206, 194/207; 902/8, 13, 14, 15
See application file for complete search history.

(56) References Cited

U.S. PATENT DOCUMENTS 2,843,378 A 7/1958 Faeber
4,378,938 A 4/1983 Staniszewski
4,903,955 A 2/1990 Manzke
(Continued)

FOREIGN PATENT DOCUMENTS

FR 2699155 A1 6/1994
(Continued)

OTHER PUBLICATIONS

International Search Report for PCT/EP2007/051303.

*Primary Examiner* — Stefanos Karmis
*Assistant Examiner* — Luis A Gonzalez
(74) *Attorney, Agent, or Firm* — Banner & Witcoff, Ltd.

(57) ABSTRACT

An equipment (43) for storing in an orderly way banknotes (52) and/or papers and the like, for instance banknotes (52) for an automatic machine (39), provided for the formation of a stack (53). The equipment (43) comprises two spiral elements (81; 82) defining coils with respective axes (83; 84) directed in the sense of the stacking and terminal sections (86) adjacent to a stacking surface (77) at an end of the stack. The spiral elements (81; 82) are rotatable around the axes (83; 84) and are arranged for laterally receiving between the coils a leading portion of the entering banknote (52), moving the banknote (52), through the coils and in consequence of the rotation, on the stacking surface (77), and disengaging the banknote from the coils adjacent to the terminal section (86).

24 Claims, 8 Drawing Sheets

U.S. PATENT DOCUMENTS

| | | | | | |
|---|---|---|---|---|---|
| 5,480,135 | A | * | 1/1996 | Nagane et al. | 271/179 |
| 5,544,876 | A | * | 8/1996 | Ruch | 271/179 |
| 5,553,840 | A | * | 9/1996 | Arikawa | 271/3.08 |
| 6,533,261 | B2 | * | 3/2003 | Katou et al. | 271/3.12 |
| 6,644,661 | B2 | * | 11/2003 | Ikeda | 271/279 |
| 7,243,914 | B2 | * | 7/2007 | Tokunaga et al. | 271/3.01 |

FOREIGN PATENT DOCUMENTS

| | | | | |
|---|---|---|---|---|
| JP | 03120127 | A | * | 5/1991 |
| JP | 11232526 | A | | 8/1999 |

* cited by examiner

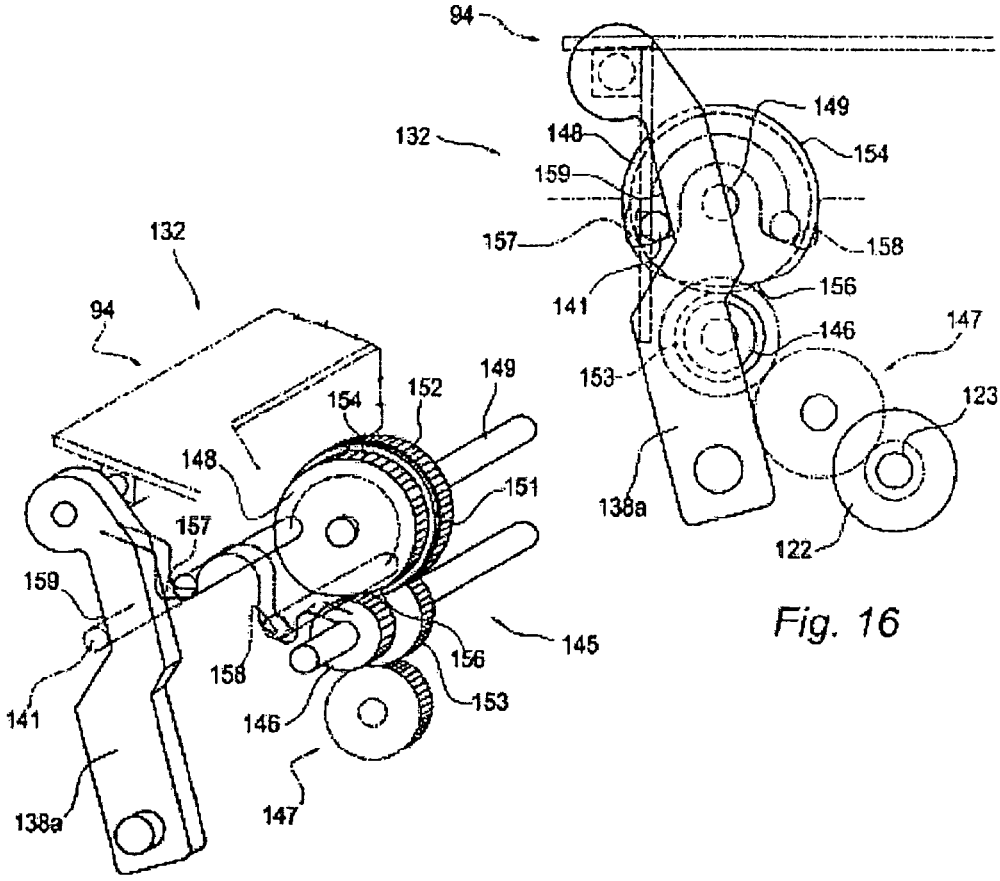
Fig. 16
Fig. 17
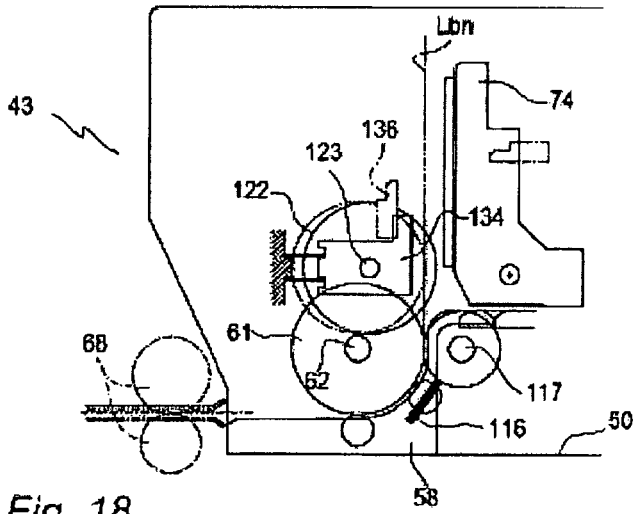
Fig. 18

EQUIPMENT FOR STORING IN AN ORDERLY WAY BANKNOTES AND/OR PAPERS AND THE LIKE

FIELD OF THE INVENTION

The invention relates to an equipment for storing in an orderly way banknotes and/or papers and the like.

More specifically, the invention relates to an equipment for storing in an orderly way banknotes and/or papers and the like, and which is provided for the formation of a stack.

BACKGROUND OF THE INVENTION

Equipments of this type are used in automatic teller machines (ATM) and self-service machines for the deposit of banknotes, and in which the deposited banknotes are stacked in stores integrated in the machine, for following processing, or in removable boxes.

These equipments can also be used in automatic teller machines (ATM) or self-service machines for the deposit and the withdrawal of banknotes and generally comprise recycling boxes in which, after suitable checks, the deposited banknotes are stacked so as to form respective stacks. The banknotes can be drawn out for following operations of payment, while the boxes are removable for the emptying or replenishment.

Basic requirements for an equipment which stores banknotes in an orderly way are: contained dimensions in relationship to the number of storing banknotes, high reliability and high operational speed even in presence of worn-out or crumpled banknotes.

In a known configuration, an equipment for storing in an orderly way banknotes and/or papers and the like comprises a box with a separation space between the area of input of the banknotes and a stacking surface of the stack. The banknotes are introduced, one at a time, and are driven on the stacking surface, for instance in upright position and support on a longer side thereof. For the separation between input and stacking surface, scratch rollers with elastic spokes are provided, which operate on the upper portion of the stack and maintain the banknotes spaced apart from the respective separation space. A movable pressing mechanism adjusts the space of formation of the stack, while guide members direct the entering banknotes to the spokes of the scratch rollers.

The phases of introduction and stacking of the banknotes are subject to serious drawbacks, depending, in detail, on the state of wear and the possible presence of bendings and curlings. The worn-out or lacerated banknotes are subjected, in fact, to bend before reaching the stack or interfere with the guide members. In turn, the deformed portions of the last stacked banknote can project in the space of insertion interfering with the entering banknote: in both cases, risks of locking are evident.

Further risks occur when the equipment is provided for storing banknotes with diversified denominations and, in a specific way, for recycling equipments provided for the withdrawal of the deposited banknotes.

Several examples of devices directed to facilitate the introduction and the orderly stacking of the banknotes in stores or boxes of teller or self-service machines are known. These devices are generally complex and/or cumbersome and expensive and subject the banknotes to various stresses with increasing of the problems of wear. Moreover, these devices present difficulties in processing together banknotes of different dimensions.

SUMMARY OF THE INVENTION

An object of the invention is to provide an equipment for storing banknotes in an orderly way, of contained dimensions and relatively high capacity, and having high reliability even with worn-out and/or folded or curled banknotes.

According to the present invention, the equipment for the orderly storage of banknotes includes at least one spiral element, which defines coils with an axis directed in the sense of formation of the stack and a terminal section adjacent to a stacking surface. The spiral element is provided for rotation around the axis and is arranged so as to laterally receive a leading portion of the entering banknote in a space of reception between the coils and so as to move axially the banknote, through the coils and in consequence of the rotation, from the space of reception to the stacking surface, with disengagement from the coils adjacent to the terminal section.

Another object of the invention is to accomplish a box for the orderly storage of banknotes for being used in an automatic teller machine or a self-service machine, having contained dimensions and relatively high capacity, and which can quickly process and with high reliability more worn-out and/or folded or curled banknotes.

According to another characteristic, the box of the invention is pre-set for, respectively, storing banknotes with formation of a stack and delivering banknotes with separation from the stack. The box includes two spiral elements, which define respective coils with axes directed in the sense of stacking and terminal sections adjacent to the stacking surface. The spiral elements are rotatable around the coil axes and are arranged to laterally receive a portion of the entering banknote and move the banknote, through the coils and in consequence of the rotation, up to the stacking surface, with disengagement from the coils adjacent to the terminal sections.

The equipment or the box can include a separation roller for singularly separating the banknotes from the stack and can define a condition of deposit, in which the stacking surface is spaced apart from the separation roller, and a condition of withdrawal, in which the stacking surface is in contact with the separation roller. A shifting device is pre-set for moving the spiral elements between an operative position and a non-operative position such that, in the operative position and in the condition of deposit, the terminal sections are adjacent to the stacking surface; downward from the separation roller in the sense of stacking and, in the non-operative position and condition of withdrawal, the terminal sections are upward from the separation roller, without interference with the unstacking banknotes.

BRIEF DESCRIPTION OF THE DRAWINGS

The characteristics of the invention will become clear from the following description given purely by way of non-limiting example, with reference to the appended drawings in which:

FIG. 16 represents a lateral schematic view of a mechanism of the equipment according to the invention;

FIG. 17 shows a perspective schematic view of the mechanism of FIG. 16; and FIG. 18 is a schematic lateral representation of some details of the equipment according to the invention.

DETAILED DESCRIPTION OF THE PREFERRED EMBODIMENTS

Figure 1:
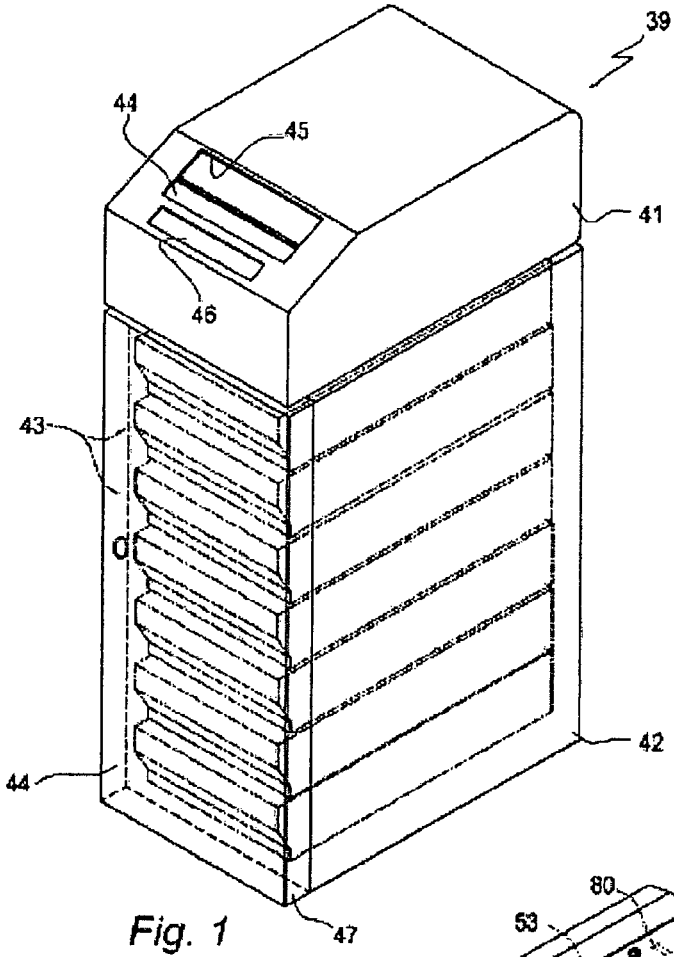
FIG. 1 represents a perspective unitary view of an automatic teller machine, which uses equipments for storing banknotes in an orderly way, exemplarily represented by deposit or recycling boxes.

In FIG. 1 is represented with 39 an automatic teller machine for the deposit and the withdrawal of banknotes (ATM), which comprises a recycling module 41 in the upper portion and a store-safe 42 in the lower portion, provided of one or more passages of communication with the form 41.

The automatic teller machine 39 uses a plurality of equipments for storing in an orderly way banknotes according to the invention, comprising, exemplarily, boxes 43, which are removably lodged in the store-safe 42. In the description which follows, the boxes 43 are pre-set even for the selective withdrawal of the stored banknotes The recycling module 41 is substantially of known type and comprises on the front: an input port 44 for banknotes to be deposited, an output port 45 for the banknotes to be withdrawn and for the rejects and a touch panel 46 as interface of communication with the user. At inside, and not shown in figure, the module 41 includes: an electronic control unit, a validation device for the banknotes, a device of temporary deposit (escrow) and mechanisms for moving the banknotes from and toward the passage or the passages of the store safe 42 and between the various devices.

The store-safe 42 has a vane, for instance frontal, of access to the boxes and closed by a door with a lock 47. Several transport and diverting mechanisms 48 (See FIG. 4), not shown in the details, are arranged behind the door 47 and provide to the selective transport of the banknotes between the module 41 and the boxes 43, inside the store-safe 42.

The boxes 43 are arranged in a condition of superimposition on a special structure of guide 49 (See FIG. 4) and are accessible for the removal through the frontal vane.

Figure 2:
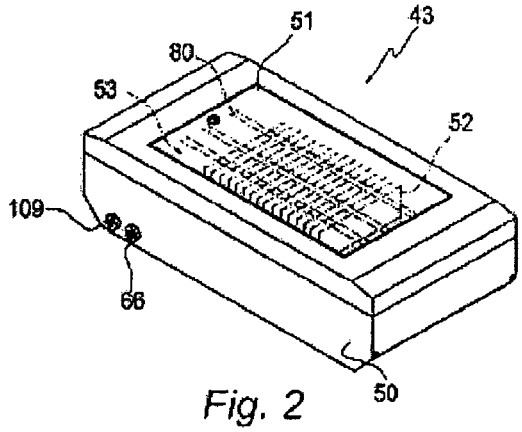
FIG. 2 shows, in a perspective upper view, a box exemplarily of the equipment for storing banknotes according to the invention.
Figure 3:
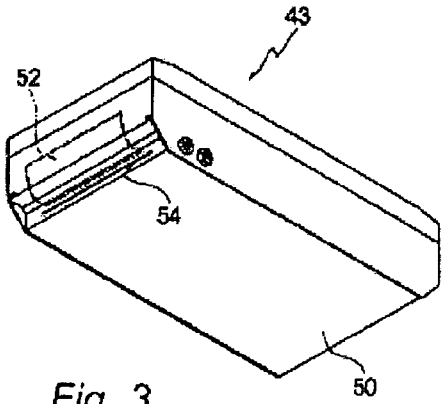
FIG. 3 is a perspective lower view of the box of FIG. 2.

Each box 43 includes a casing 50 (FIGS. 2, 3 and 4), of substantially lengthened parallelepiped shape provided of a cover 51 with lock, for storing, in an orderly way, banknotes 52, overposed to form respective stacks 53. A conventional front of the casing 50 shows, in a lower portion, a recess with a slit 54, through which the banknotes 52 can enter for being stored, or go out for the withdrawal or for other operations. To the inside, two sides 56*a* and 56*b* (FIG. 5) and an arrest surface 57, horizontal in the use, are also provided.

The box 43 is configurable between a condition of deposit, in which the banknotes 52 entering from the slit 54 are stored and form the stack 53, and a condition of withdrawal, in which the stored banknotes are singularly separated from the stack 53 and go out of the slit 54. As it will be better described in the following, introduction/extraction elements, a stack separation member and a moving mechanism for the stack are provided.

Figure 8:
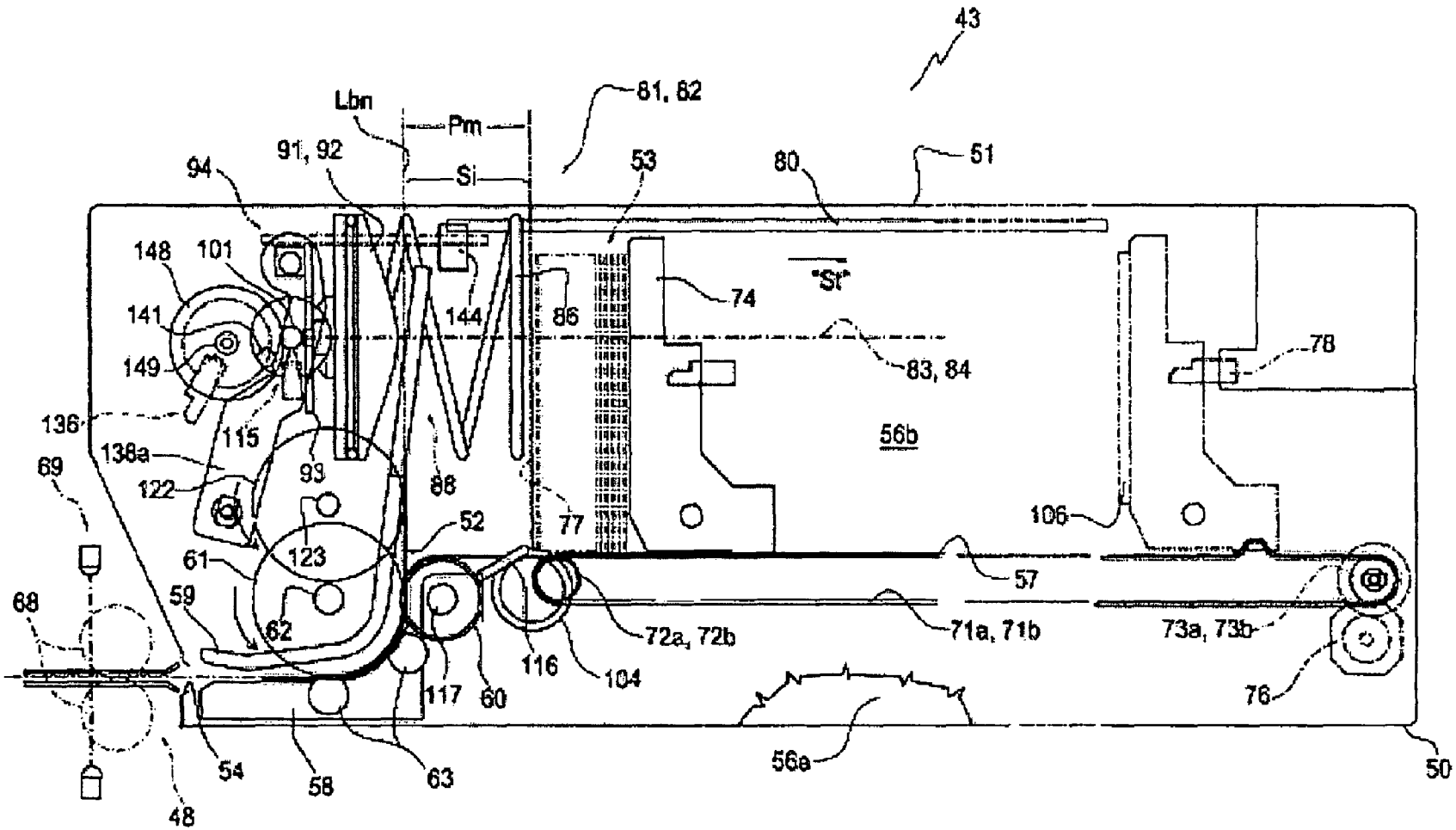
FIG. 8 is a schematic sectioned side view of the equipment according to the invention.

In the deposit condition, the stack 53 is separated from the stack separation member by a space of insertion "Si" in which a member of separation operates to hold back the stack 53 in formation and to facilitate the stacking of the banknotes. A shaped block 58 (FIG. 8) and a guiding plate 59 define a passage for the banknotes 52 in input or in output.

The shaped block 58 defines front and back planar sections and an arched intermediate section. The front section is underneath the surface 57 and is coplanar with the slit 54. The back section is coplanar with the surface 57, while the intermediate section has a tangent surface substantially vertical in a portion of connection with the back section. The guiding plate 59 has a front section faced on the front section of the block 58, an arched section faced on the intermediate section of the block 58 and a free section. This free section extends in vertical and represents the limit upward from the insertion space "Si".

Figure 4:
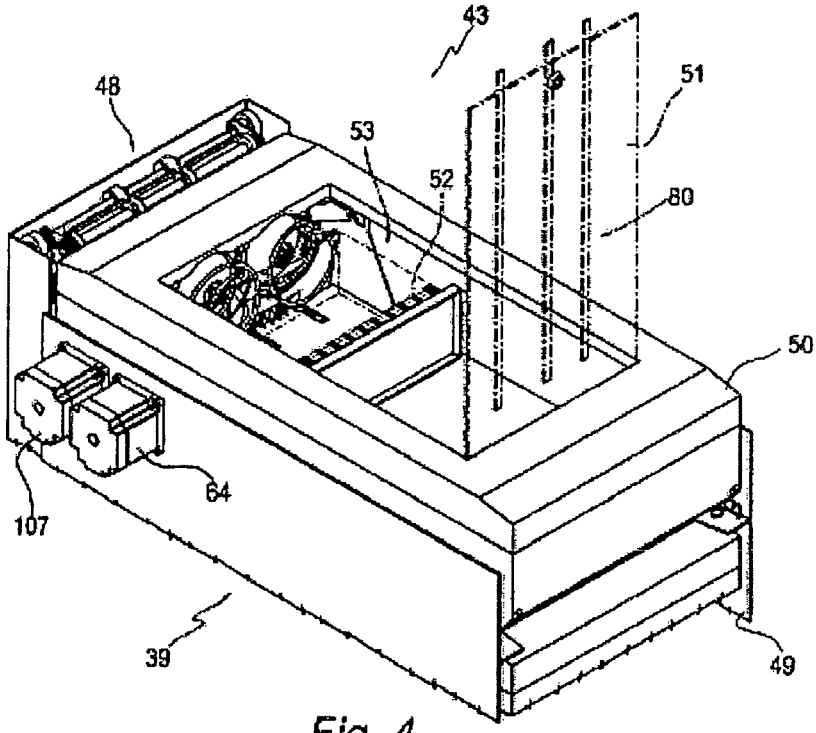
FIG. 4 represents a partial perspective view of the box exemplarily of the equipment according to the invention and details of the automatic teller machine in which the box can be mounted.
Figure 5:
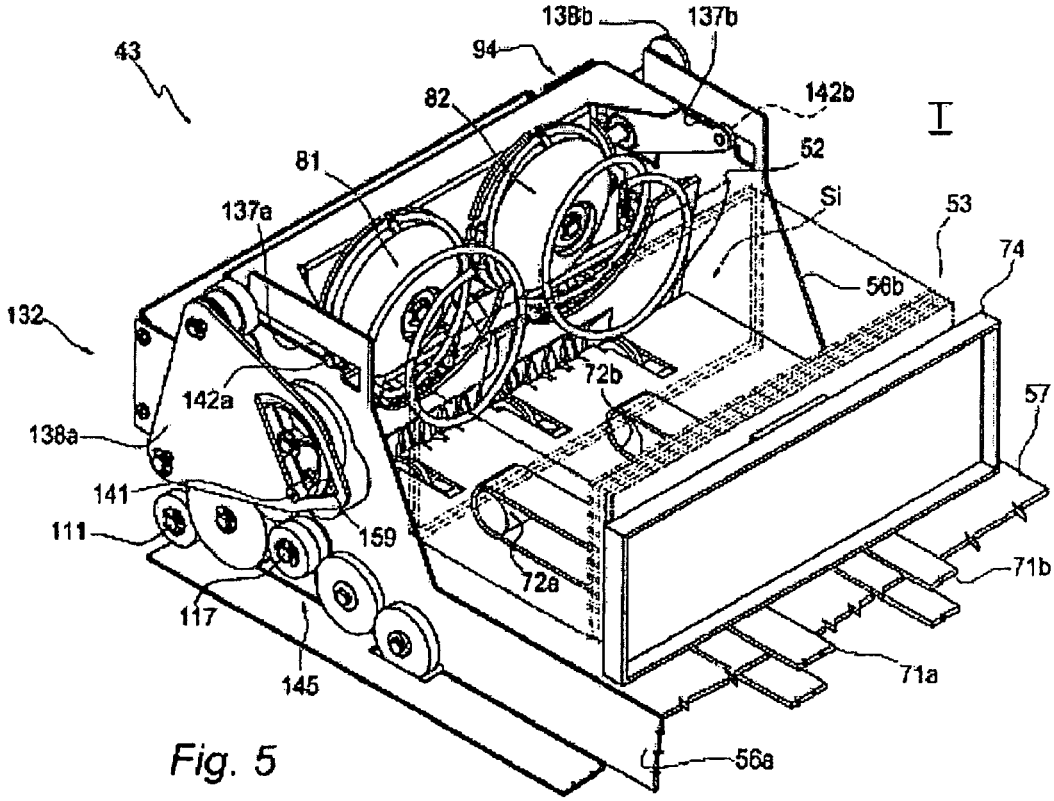
FIG. 5 represents an upper view of some components of the box of FIG. 4, in a given functional condition.
Figure 7:
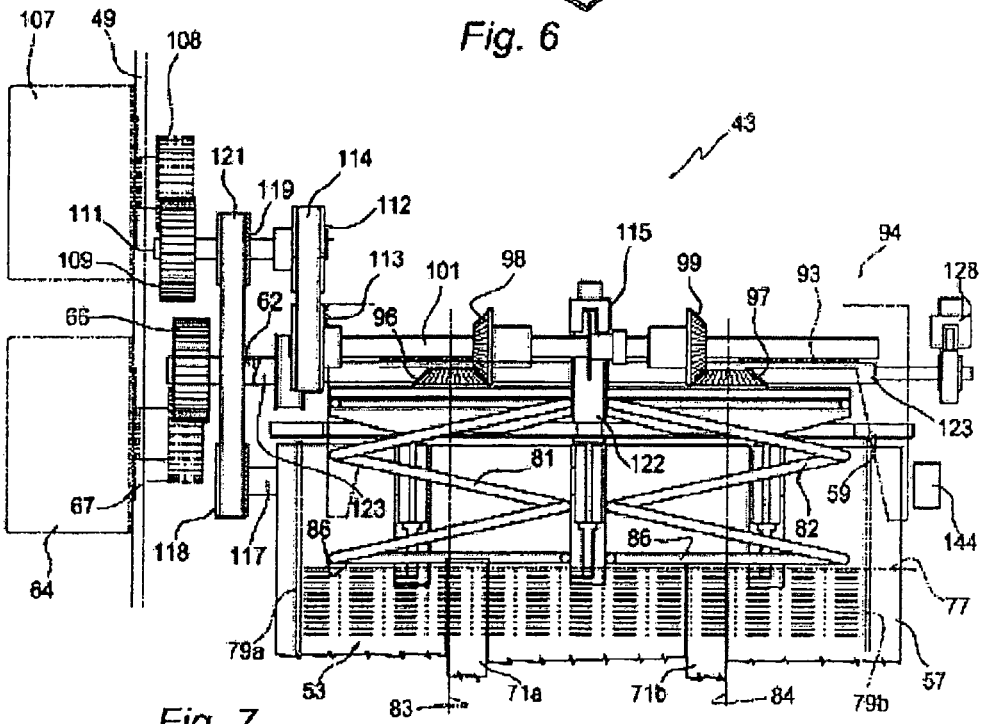
FIG. 7 is a schematic planar view of some components of the equipment according to the invention, in the functional condition of the box of FIG. 5.

As elements for the introduction/extraction of the banknotes, the box 43 includes motor rollers 61 keyed on a shaft 62, drawing rollers 60 and pinch rollers 63 and in which the shaft 62 is actuated by a motor 64 of the automatic teller machine 39 (See FIGS. 4 and 7). In detail, an end of the shaft 62 projects from a side of the casing 50 and supports a driven toothed wheel 66; the motor 64 has an output shaft with a toothed wheel 67, while the driven toothed wheel 66 is adapted to engage for the rotation the toothed wheel 67 at the moment of the mounting of the box in the structure 49.

With box 43 mounted on the machine 39, the slit 54 is in front of two input/output rollers 68 (FIG. 8) of the transport mechanism 48 and the passage of the banknotes is revealed by a photoelectric pair 69. In a deposit condition, a banknote 52 entered by the rollers 68 crosses the slit 54 between the block 58 and the plate 59. Thereafter, the banknote is taken by the motor rollers 61 and the pinch rollers 63. For the action of the rollers 61, which rotate in a counter clockwise sense, the banknote emerges from the block 58 in the space of insertion "Si", guided by a free portion of the plate 59. The position of the banknote is substantially vertical, defined by a movement surface "Lbn".

With respect to the movement surface "Lbn", in proximity of the input, the drawing rollers 60 are arranged with interference by opposite parts with respect to the motor rollers 61 and are sized so as to transversally deform the entering banknotes in function of stiffening along the direction of introduction.

Figure 13:
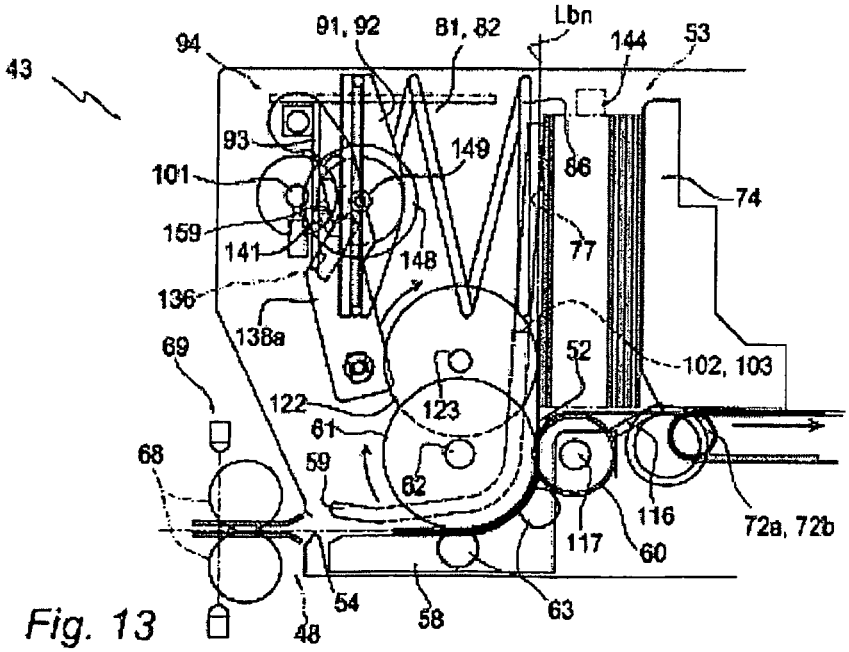
FIG. 13 shows some components of FIG. 8 in the functional condition of FIG. 12.

In the condition of withdrawal, a banknote 52 separated from the stack 53 and lying on the surface "Lbn" (FIG. 13), is nipped between the motor rollers 61 and the pinch rollers 63. For the action of the rollers 61, the banknote emerges from the block 58, crosses the slit 54 and is extracted by the rollers 68 for being transported by the mechanism 48 of the machine 39.

As for the moving mechanism of the stack 53, the box 43 includes a pair of lengthened toothed belts 71*a* and 71*b* (FIGS. 5 and 8), toothed pulleys 72*a*, 73*a* and 72*b*, 73*b* of guide and drive, a substantially vertical pushing plate 74 and a motor 76.

The toothed belts 71*a* and 71*b* are adjacent each the other at a distance less than the length of the banknotes of smaller dimension and extend from a back wall toward the front of the box, up to the back section of the block 58. The toothed pulleys are arranged underneath the arrest surface 57 and the motor 76 drives the motor pulleys 73*a* and 73*b* through return gears. The upper branches of the belts 71*a* and 71*b* are lodged in corresponding slots of the arrest surface 57 and project of few from this surface, in a manner known per sé.

The pushing plate 74 is fixed on the upper branches of the toothed belts 71*a* and 71*b* and has possibility of movement for the whole useful length of the box. The banknotes of the stack 53 are supported with the longer edge on the upper branches of the belts; the first entered banknote is in contact with the plate 74, while the last entered banknote defines a stacking surface 77 of the stack for the following entering banknote. A sensor 78 recognizes the condition of end stroke of the plate 74 and of full box.

In a condition of deposit, the surface 77 is at a distance "Pm" from the movement surface "Lbn" and from the guiding plate 59. Further, the stack 53 is confined between the sides 56*a* and 56*b* or between the stop members 79*a* and 79*b* and, on the upper part, by stop tiles 80 supported, for instance, by the box 51. The stop members 79*a* and 79*b* and the tiles 80 have possibility of adjustment in horizontal and in height, respectively, to define optimal limits for the banknotes of the stack, in the case in which the box is specialized for predetermined denominations of banknotes.

According to the invention, the equipment exemplarily represented by the box 43 includes, as member of separation between the input and the stack, at least one spiral element, and specifically two spiral elements 81 and 82 (FIGS. 5, 7, 8 and 15), defining coils with respective axes 83, 84 directed in the sense of stacking. In an operative condition for the stacking, the elements 81 and 82 extend themselves in the space of insertion "Si" and define a space of reception 88 between the defined coils. The space "Si" is intersected by the surface "Lbn" of the entering banknotes and is downward limited by respective terminal sections 86 of the spiral elements 81 and 82. The terminal sections 86 constitute a limit for the banknotes 52 of the stack and a stable support for their vertical position.

Each spiral element 81, 82 is provided for rotation around the respective shaft 83, 84, and is arranged so as to laterally receive (from the low in FIG. 8) a leading portion of the entering banknote 52 in the space of reception 88. The element 81, 82 are such to axially move the banknote 52, through the respective coils and in consequence of the rotation, from the space of reception 88 to the stacking surface 77, with disengagement from the coils adjacent to the terminal section 86.

The action of the spiral elements is, therefore, similar to the action pursued by a cochlea on engaged loose elements to be dragged. On the contrary, the terminal sections 86 pursue an opposition action on the banknotes of the stack 53 either when the spiral elements are at rest, or when the elements are in rotation. With such structure, the spiral elements 81, 82 effectively achieve the function of member of separation between the stack in formation and the elements for the introduction/extraction of the banknotes.

The spiral element 81, 82 can be formed by a helical wire of cylindrical type of given inclination (around 15°) in the space of reception 88. The inclination of the coils is then decreasing up to a portion of substantially null inclination in correspondence of the terminal section 86; the overall length results of around 1.5 coils.

Figure 15:
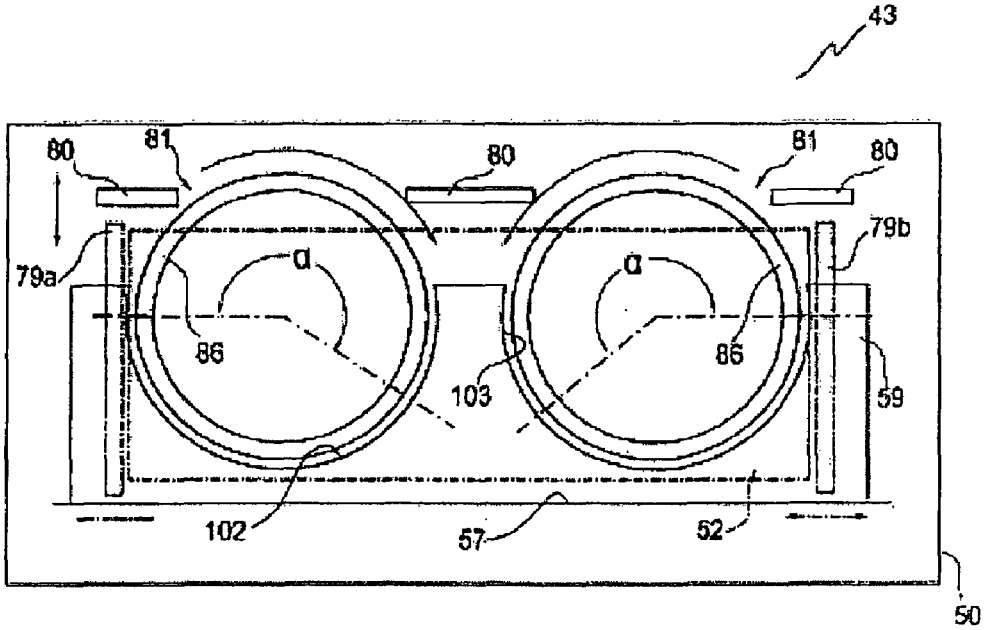
FIG. 15 shows a schematic back view of some components of the equipment according to the invention.

The portion of substantially null inclination extends for an angle "α" of around 200° (See FIG. 15). Thus, the section 86 defines a support surface substantially planar, perpendicular to the shaft 83, 84. The free end of the helical wire leaves a large space for the disengagement of the banknote from the coils adjacent to the elements 81, 82. The helical wire is, for instance, of relatively stiff steel, with thickness of around 2÷4 mm. For a banknote or other paper or card, of maximum height equal to "H", the diameter of each element 81, 82 is included between 0.4H and 1.2H, preferably in the interval 0.7H÷1.0H. The compliance of the coils is very limited and the deformation, in the operative conditions, is of few mm.

By opposite parts of the sections 86, the spiral elements 81, 82 are fixed, according to pre-defined angular positions, on mounting edges of respective discoid supports 91 and 92. These supports are mounted, with possibility of rotation, on a plate 93, substantially vertical, arranged upward from the guiding plate 59 and along a stacking sense "St". The plate 93 is constituted by a bend of a carriage 94 extending transversally between the sides 56*a* and 56*b*.

The discoid supports 91 and 92 present each one a frusto-conical section radiused with the mounting edges and a respective hub projecting from the plate 93 by opposite parts with respect to the frusto-conical section. The frusto-conical section has rounded vertex, concurrent with the spiral elements 81, 82, adjacent to the space of reception 88 and, in the condition of deposit, a little upward from the guiding plate 59. The hubs of the supports 91 and 92 are part of identical conic gears 96 and 97, which are in turn in engagement with corresponding identical driving gears 98 and 99 of a transmission shaft 101 supported by the plate 93.

The spiral elements 81, 82 are placed side by side, and have the respective axes 83 and 84 substantially coplanar and parallel to the arrest surface 57 (See FIG. 15). The coils of the elements 81 and 82 are spaced apart each the other and operate on lateral and upper areas of the banknote to be stacked. Conveniently, the arrangement is such that the distance between the upper sector of the coils and the arrest surface is greater than the height of the banknotes of higher dimensions.

The guiding plate 59 defines on the upper part two arc shaped edges 102 and 103, with extension of a little more than 180° and concavity directed upwardly, and in which the coils of the elements 81 and 82 are freely lodged. The stop tiles 80 are arranged up there, at the sides of the elements 81, 82, and prevent that, at the moment of the entering, the upper edges of the banknotes can touch the inside portions of the coils in correspondence of the upper sectors.

The spiral elements 81, 82 are extended toward the pushing plate 74 and have opposed senses of wrapping. The couplings between the gears 96 and 97 and between the gears 98 and 99 are such to make the spiral elements 81 and 82 to rotate in synchronism and according to opposed senses of rotation.

Moreover, the senses of wrapping of the coils and the senses of rotation of the spiral elements 81, 82 are such that the disengagement of the banknote from the terminal sections 86 begins from central areas of the banknote 52 and progressively continues toward the lateral areas. With this, the free ends of the terminal sections 86 pursue, in their movement, an action of smoothing on the banknote just overlapped, which also continues during the moving and up to the disengagement of the following banknote.

The box 43 can further include toothed carrying wheels 104 (FIG. 8), projecting a little from the arrest surface 57, arranged upward from the belts 71*a*, 71*b* and continuously rotating in the use, for instance, in dependence on a connection with the rollers 61. The carrying wheels 104 urge the lower edges of the last stacked banknotes in the sense of stacking "St" so as to pursue a light pressure on the lower portions of the terminal sections 86 of the spiral elements 81 and 82.

A projection 106 of few mm, in a median area of the pushing plate 74, causes an effective smoothing of the banknotes to be stacked, when the stack 53 is constituted by a limited quantity of items.

The action of smoothing of the two terminal sections 86 facilitates the stacking even in presence of worn-out banknotes and maintains the stack 53 relatively compacted and under optimal conditions for the un-stacking operation. At the same time, the actions of the coils and the terminal sections of the spiral elements 81, 82 are delicate and do not cause stresses and additional wear on worn-out banknotes.

The box 43 provides a servomechanism with electronic circuits, not represented in drawings, for the control and/or the command of rotation of the spiral elements 81, 82. The servomechanism information is servoized to information of passage of the banknote to be stacked for revealing the angular phase of the elements 81, 82 so that an entering banknote is not hindered by the coils, and has full liberty of positioning in the space of reception 88. The control circuits and the motor of the servomechanism are integrated in the automatic teller machine 39, but it is clear that circuits and motor can be mounted on the same box 43.

As an example, the servomechanism for each box 43 includes a motor 107 (FIGS. 4 and 7) with an output shaft and a toothed wheel 108, mounted on the structure of guide 49 and driven by the unity of control of the automatic teller machine 39. The box 43 includes a driven toothed wheel 109, keyed on a shaft 111 and provided for engaging with the toothed wheel 108 at the moment of the mounting of the box in the structure 49. The toothed wheel 109 is connected to the transmission shaft 101 through toothed pulleys 112 and 113, keyed on the shaft 111 and on the shaft 101, and a toothed belt 114.

A photoelectric sensor 115 recognizes the angular position of the transmission shaft 101, while the electronic unit of the machine 39 responds to information of transit from the photoelectric pair 69, varying the velocity of rotation of the motor 107 so as to dynamically maintain in phase the spiral elements 81, 82 with the leading edge of the banknote to be stacked. In other words, the mean velocity of the motor 107 is such that, for a continuous flow of entering banknotes, the leading edge of the banknote always founds the vane of the coils. The action of the servomechanism is to accelerate or decelerate the motor 107, in order to compensate any delay or advance of the entering banknote with respect to the time of entering in the space "Si."

Figure 6:
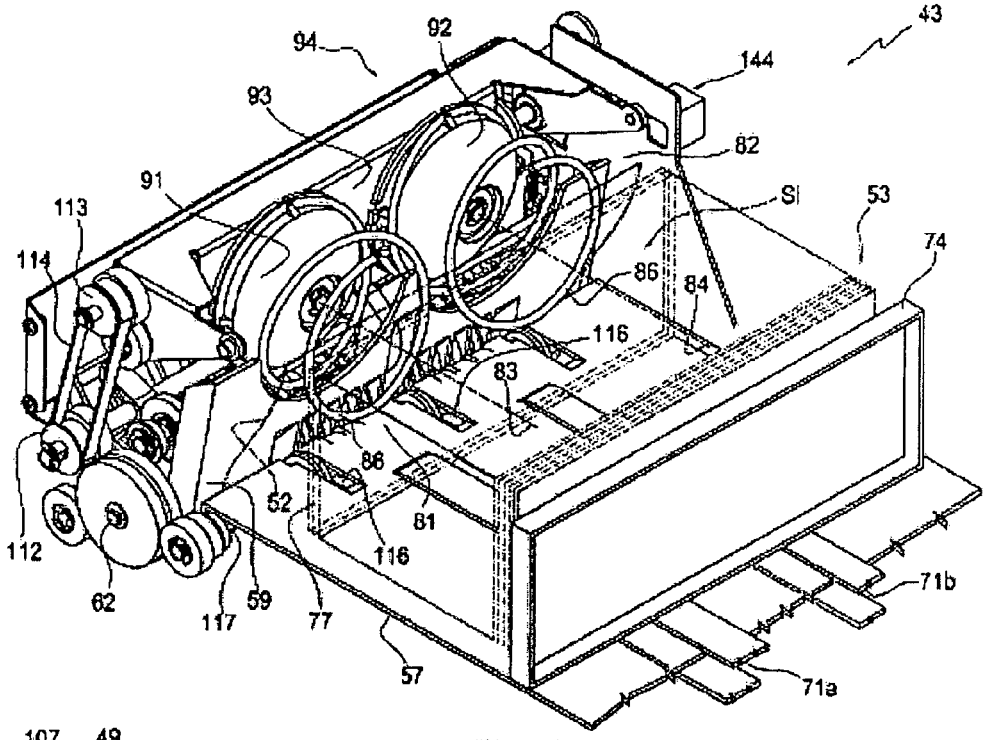
FIG. 6 shows another upper view of details of the box of FIG. 5.

The box 43 also includes one or more shovel elements 116 (FIG. 6), relatively yielding, for instance small belts or thin plates in rubber or plastic, carried by a hub keyed on a shaft 117. The shovel element or elements 116 are arranged in the upper portion of the shaped block 58 and, in their movement, project from the arrest surface 57 through respective slots. Further, the shaft 117 idle supports in the rotation the drawing rollers 60.

Figure 9:
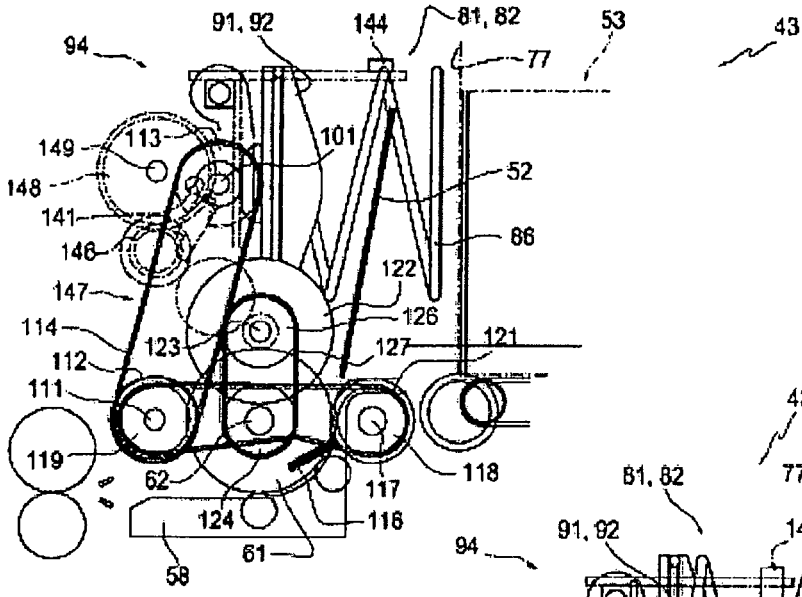
FIGS. 9, 10 and 11 show schematic lateral views of some components of the equipment of the invention, in different phases of operation.
Figure 10:
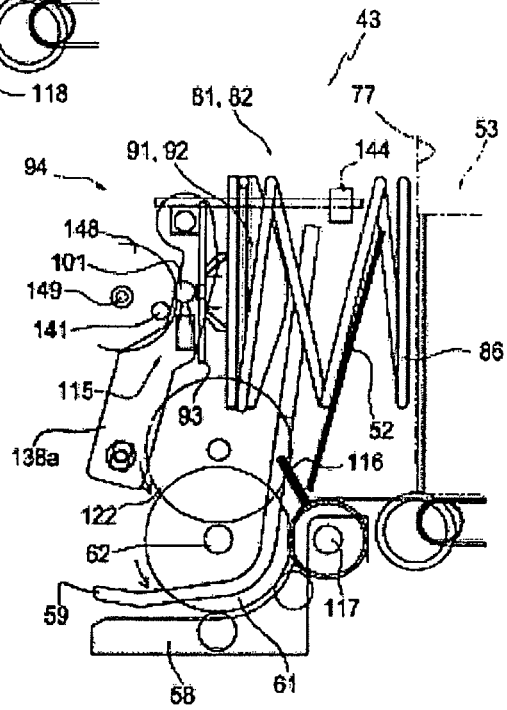
Figure 11:
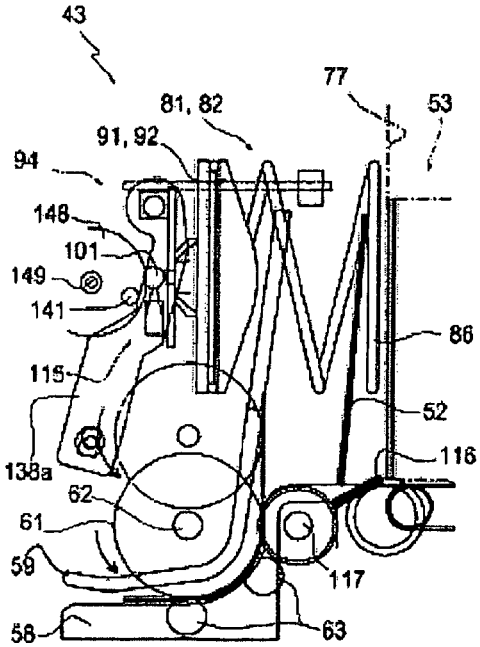

The shaft 117 is cinematically connected with the spiral elements, while the shovel element or elements 116 push away the lower trailing edges of the entering banknotes in synchronism with the action of the coils of the elements 81, 82, as represented in FIGS. 9-11, for facilitating the stacking. The connection between the shovel element or elements 116 and the spiral elements 81, 82 is accomplished, for instance, by toothed pulleys 118 and 119 keyed on the shaft 117 and on the shaft 111 and through a toothed belt 121 in engagement with the pulleys 118 and 119.

In preparation of the stacking, the moving mechanism of the stack is actuated in response to a signal of transit of the photoelectric cell 69, making moving back the pushing plate 74 of a stroke substantially equal to the thickness of the banknote. By this, the action of opposition on the banknotes is reduced. In alternative, in view of the clearance allowed by the spiral elements 81, 82, the pushing plate can be moved back after the introduction of more than one banknote, for instance after the stacking of about ten items.

As for the withdrawal of the banknotes, the box 43 singularly separates the banknotes of the stack 53. To this end, a separation roller 122 is keyed on a shaft 123, arranged above the shaft 62. The roller 122 is disposed in a median position between the sides 56*a* and 56*b*, in a condition of substantial tangency with the surface "Lbn". The stack 53 is moreover shiftable by its moving mechanism, whereby overcoming the space of insertion "Si", up to carry the stacking surface 77, which now constitutes the surface of un-stacking operation, in pressure against the roller 122.

The separation roller 122 has the same diameter of the motor rollers 61 and includes a high friction sector. A pair of pulleys 124 and 126 and a toothed belt 127 connect the shaft 123 with the shaft 62, ensuring synchronism and the same sense of rotation.

The separation of the banknotes is associated to a sense of rotation of the rollers 61 and 122 opposite to the sense of rotation provided for the introduction. In detail, the separating roller 122 separates from the stack 53 the banknote supported by the surface 77 through its high friction sector. Thereafter, the motor rollers 61 provide to move the separated banknote and extract it through the slit 54, in correspondence of the contact of the surface 77 with the sector of the roller 122 external to the high friction sector. A photoelectric sensor 128 supplies information of position of the shaft 123, associated with the angular position of the high friction sector and functional to the process of un-stacking, in agreement with a known technique.

According to another aspect of the invention, the equipment exemplarily represented by the box 43 includes members of guide and connection and a cyclical actuating mechanism 132 for moving the spiral elements 81 and 82 between the operative position above defined and a non-operative position.

As previously described, in the operative position regarding the condition of deposit (FIGS. 6, 7 and 8), the terminal sections 86 of the spiral elements are in contact or adjacent to the stacking surface 77. The sections 86 are downward from the separate roller 122, in the sense of stacking, and project with respect to the arc shaped edges 102 and 103 of the guiding plate 59.

Figure 12:
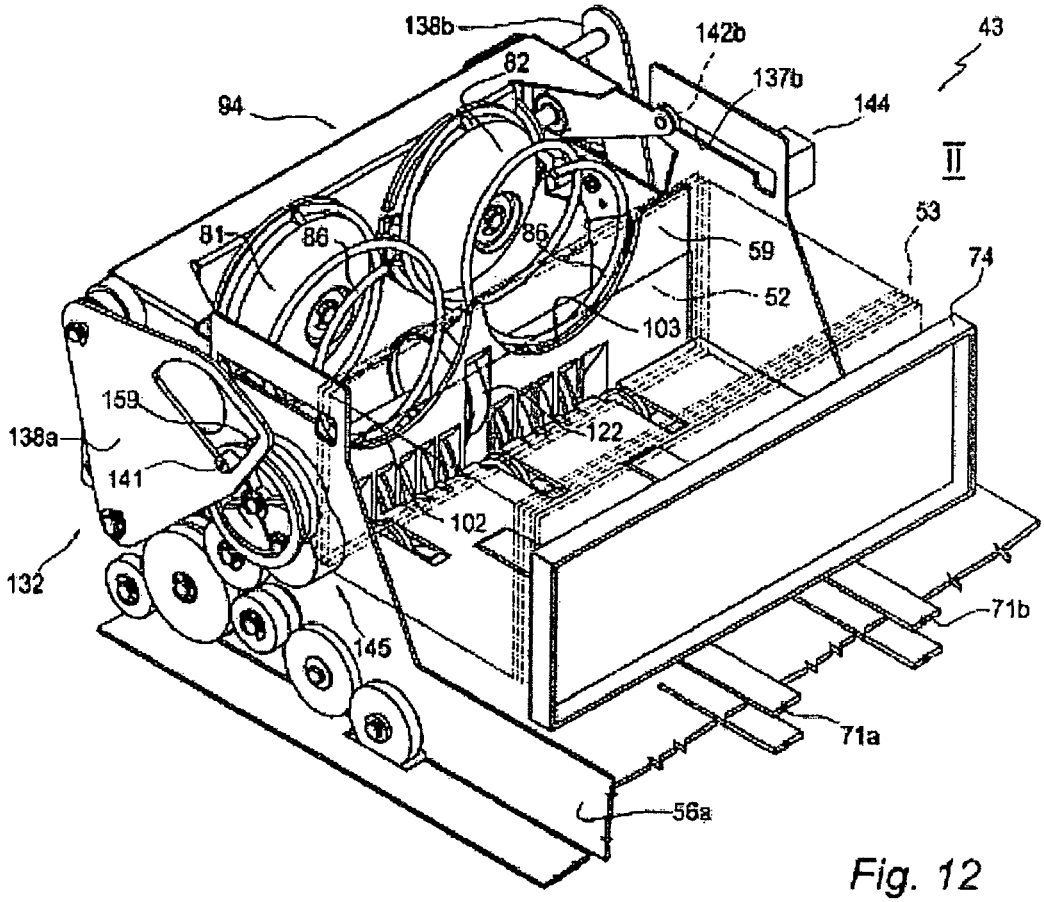
FIG. 12 represents the components of FIG. 5, in another functional condition.

In the non-operative position and in correspondence with the condition of withdrawal (FIGS. 12 and 13), the terminal sections 86 are upward from the stacking surface 77. The terminal sections are retracted with respect to the arc shaped edges 102 and 103 of the guiding plate 59, are spaced apart from the surface 77 and do not interfere with the un-stacking banknotes 52.

To identify the movement surface "Lbn" (FIG. 18) with respect to the position of the stacking surface 77, the shaft 123 of the roller 122 is mounted on an elastically yielding support 134 and its shifting is recognizable through a photosensor 136. The position of the stacking surface 77 is referred to the surface "Lbn" as steps of the motor 76 stored in a respective position counter, for instance included in the unity of electronic control of the machine 39.

The position counter is resetted after a shifting of the spiral elements 81 and 82 in the non-operative position and a cycle of synchronization of the moving mechanism, which moves the stack 53 up to carry the surface 77 on the movement surface "Lbn". The reaching of the surface "Lbn" is recognized when the stack 53 moves the roller 122, as indicated in the stroke and dot line in FIG. 18, with signalling of the sensor 136 and consequent arrest of the moving mechanism. In the case of absence of banknotes, this action is directly pursued by the pushing plate 74.

The synchronization cycle can be provided, in a phase of initialization of the equipment, by actuating the moving mechanism for a shifting of the stack in the direction opposite to the sense of stacking "St". The synchronization cycle can periodically be repeated in the condition of deposit, for each new phase of deposit of banknotes, or when it is held necessary or useful.

The members of guide and connection relate to the carriage 94 and include guiding slots 137*a* and 137*b* (FIGS. 5 and 12), horizontal in the use, and arms 138*a* and 138*b*. The slots 137*a* and 137*b* are obtained in the sides 56*a*, 56*b*, and these sides support the fulcrums of the arms 138*a* and 138*b*. The actuating mechanism 132 includes, in turn, a control-actuation element defined by a pin 141.

Figure 14:
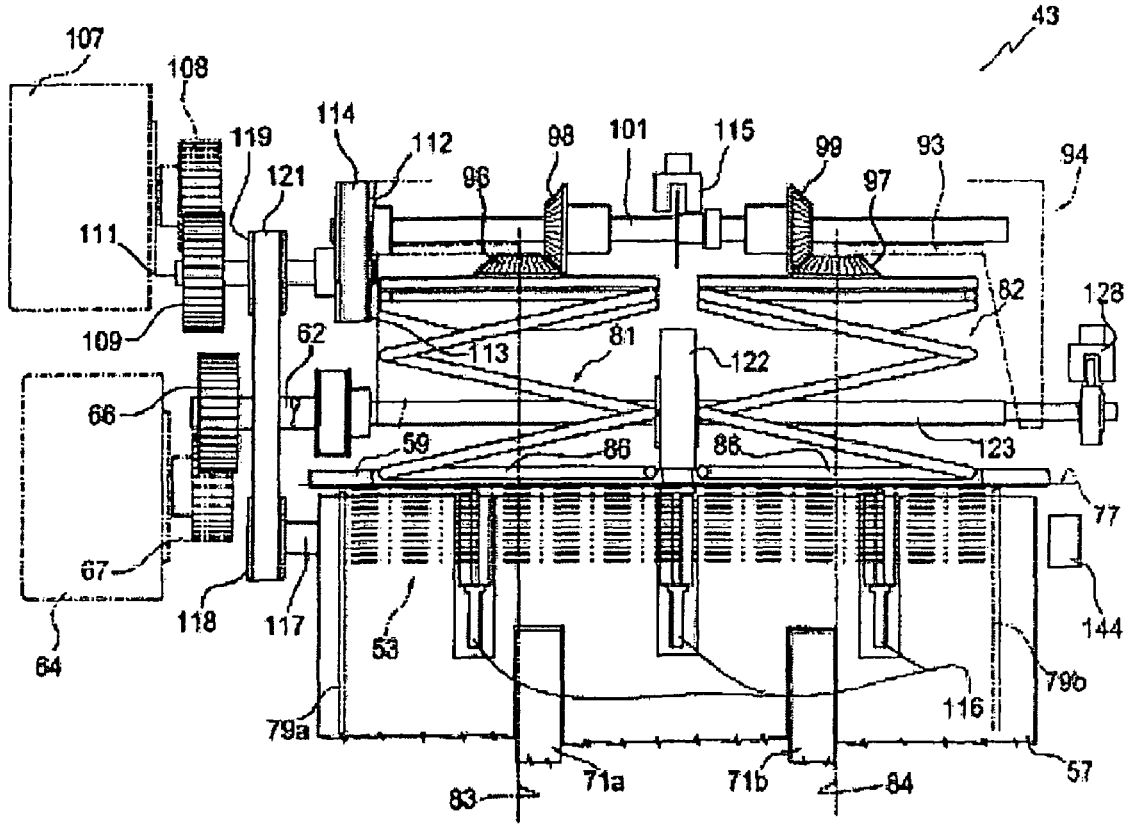
FIG. 14 represents the scheme of FIG. 5 in the functional condition of FIG. 12.

In detail, the carriage 94 is arranged in an upper portion of the box 43 and includes guiding pins 142*a*, 142*b* and connection pins. The pins 142*a*, 142*b* are driven slidably in the slots 137*a* and 137*b*, while the connection pins are mounted on terminal portions of the arms 138*a*, 138*b*. The slots 137*a* and 137*b* and the arms 138*a* and 138*b* define the operative position and the non-operative position of the spiral elements 81 and 82 (FIGS. 7, 9 and 14), for the combined action of the pin 141 on the arm 137*a*.

A photoelectric sensor 144 is pre-set to recognize the position of the carriage 94 corresponding to the operative position of the spiral elements 81 and 82. The toothed belt 114 and the pulleys 112 and 113 ensure that the spiral elements and the shovel elements maintain the synchronization and the angular phasing after shiftings of the carriage 94 and returns in the operative position.

According to another characteristic of the invention, the actuating mechanism 132 (FIGS. 16 and 17) has a control member 145 which is sensitive to the sense of rotation of the motor rollers 61 and of the separate roller 122. The mechanism 132 takes in turn the motion from the same motor 64 which rotates the rollers 61 and 122.

Specifically, the mechanism 132 includes a driving gear 146, which is connected with the shaft 123 through a chain of gears 147 and a driven gear 148, rotatable on a shaft 149, of control for the pin 141. The control member 145 includes a friction element 151, also rotatable on the shaft 149, which cooperates with the driven gear 148. The element 151 is connected in the rotation with the driving gear 146 and, therefore, with the shaft 123 through a pair of toothed wheels 152 and 153, respectively, rotatable on the shaft 149 and integral in the rotation with the gear 146.

The driven gear 148 has a partial toothing 154 engageable with the driving gear 146 and a free section 156 devoid of toothing. The pin 141 is integral in the rotation with the driven gear 148 and is shiftable between two end stroke stops 157 and 158 obtained in the structure of the box 43.

The end stroke stops 157 and 158 are associated with terminal portions of the free section 156 so that, when the pin is arrested against one of the stops 157 or 158, the teeth of the driving gear 146 are in front of the free section 156 and are therefore disengaged from the partial toothing 154. The position of the end stroke stop 157 corresponds to the operative position of the spiral elements, while the other stop 158 corresponds to the respective non-operative position.

As element of control, the pin 141 is pre-set to maintain arrested the carriage 94 in the condition of deposit of the banknotes and during the transition toward the condition of withdrawal. In the function of element of actuation, the pin 141 is pre-set to move positively the carriage 94 under the action of the motor 64 and in association with the engaging of the partial toothing 154 with the driving gear 148.

In condition of use, the driving gear 146 is faced to the free section 156 and it does not pursue any action on the driven gear 148. The friction element 152 slides in turn on the gear 148 and operates on the gear 148 so as to push the pin 141 against the stop 158 or against the stop 157, according to the sense of rotation of the motor 64.

The friction element 151 is pre-set to rotate the second gear 148 from the first stop 157 to the second stop 158, or from the second stop to the first stop up to the conditions of engagement of the toothing 154 with the driving gear 146, and in response to any inversion of the sense of motion of the motor 64. The partial toothing 154 extends itself for around 180°, while the trajectory of the pin 141 is of around 220°. The pin 141 is adapted to cooperate with a cam portion 159 obtained in the arm 138*a* of the carriage 94, and the positions of end stroke on the structure of the box correspond to positions of extra dead point of the pin.

The friction element 152 slides continuously on the driven gear and on the pin 141. The transmitted torque is intentionally weak, insufficient to actuate a substantial shifting of the carriage 94, such as to reduce at a minimum value the absorption of power of the device. However, the positions of arrest of the pin in correspondence of the extra dead points are such that the starting torque necessary for overcoming the extra dead points, is limited and less than the torque pursued by the friction element 152.

With this sizing, at each inversion of the sense of motion, the torque of the friction element causes the rotation of the driven gear 148 and, therefore, of the pin 141 of about 20° before the respective position of dead point, determining the condition of engaging of the partial toothing 154 with the driving gear 146: the gear 146 now operates in positive way on the driven gear 148, and the pin 141 can positively move the arm 138*a* through the cam portion 159, whereby moving the carriage 94, or controlling the position of the arm 138*a* and, therefore, of the carriage 94, in the desired way.

After the rotation of 180° corresponding to the reaching of the other dead point, the interruption of the toothing 154 causes the end of the positive control of the driving gear 148. The friction element makes to continue nevertheless the rotation of the driven gear and the relative pin for about 20°, without substantial shifting of the carriage, up to when the pin 141 does not meet the end stroke stop in the other position of extra dead point.

To the shifting of the pin 141, which follows the inversion of the sense of rotation of the motor shaft, is associated the actuation of the moving mechanism for moving the stack of banknotes between the condition of deposit and the condition of withdrawal.

The action between the cam portion 159 and the pin 141 is unidirectional, in such way that the pin controls positively the shifting of the carriage 94 between the non-operative position and the operative position of the spiral elements, while the moving mechanism moves the stack substantially following and making it easier the motion of the spiral elements.

For the change from the condition of withdrawal to the condition of deposit, the motor 64 is arrested when the photoelectric sensor 144 recognizes that the carriage 94 has reached a position such to carry the terminal sections of the elements 81 and 82 at the distance "Pm" from the position "Lbn".

On the contrary, the shifting of the carriage 94 between the operative position and the non-operative position of the spiral elements is positively actuated. To this provides the moving mechanism of the stack, through the pushing plate 74 and the stack of banknotes 53. In this case, it is the cam portion of the arm 138*a* to follow the pin 141 in movement between the second position and the first position. The movement of the stack 53 is anticipated with respect to the cycle of actuation of the mechanism 132 to avoid undue un-stacking operations. The shifting ends, with arrest of the motor 76 on signal of the sensor 136, when the stack of banknotes moves the separation roller 122, thus signalling that the stacking surface 77 has reached the position for the separating operation.

Naturally, the principle of the invention remaining the same, the embodiments and the details of construction of the equipment for storing in an orderly way banknotes and/or papers and the like can be widely varied with respect to what has been described and illustrated, by way of non limitative example, without by this departing from the scope of the present claimed invention.

As an example, the above described equipment can be used, without departing from the scope of the invention, for storing papers or other flat elements as cards and similar, different from the banknotes, with formation of a corresponding stack, in front of different sizing of the herein described components. The movement of the stack can be effected through negative controls, for instance through springs loaded or recovered by motor.

Instead of a pair of spiral elements, a single spiral element can be used, providing suitable element of contrast for the action of rotation of the spiral element on the banknote. On the other hand, if held opportune, more than two spiral elements, also of different dimensions, can be provided to take account of different typologies of banknotes and papers.

In alternative to the stiff spiral elements 81, 82, the equipment of the invention can use spiral elements of controlled yielding, adapted to be deformed by the moving mechanism of the stack, in association with the change of configuration between the condition of deposit and the condition of withdrawal. The terminal sections 86 are moved beyond the surface "Lbn" and a locking mechanism provides to hold back such sections updown from the surface "Lbn" and to maintain compressed the spiral elements. An un-locking mechanism will provide to unhook the terminal sections 86 upon the return of the equipment in the condition of deposit and the shifting of the pushing plate, with consequent release of the elements 81 and 82. The spiral elements of controlled yielding will maintain compressed the stack 53, up to when the surface 77 has reached the distance "Pm".

The stack of banknotes can have vertical extension, with stacking from the upper or with stacking from the low, without need of toothed belts for the pushing plate. In a first solution, the spiral elements are arranged in the upper portion of the device and the stack is urged upward by the pushing plate motorized or urged by springs. A second solution, simplified and for stacks of reduced dimensions, provides spiral elements in the lower portion, while the pushing plate urges downward the stack of banknotes for gravity and/or through light springs.

The indications of passage of the banknotes can be supplied by photoelectric elements, arranged in different portions by those indicated in the description. Other sensors, and/or other information supplied by the system in which the equipment is applied can be also provided.

The shifting of the spiral element between the position of stacking and the position retracted for the unstacking operation can be effected by a specific mechanism, for instance controlled by a further motor.

The above described cyclical actuating mechanism, with control sensitive to the sense of rotation of elements of introduction or unstacking operation can also be used in equipments which provide a member of separation different by the spiral elements and, for instance, similar to the member of separation of the equipment for deposit and withdrawal of banknotes of known type.

The energy for the shifting of the spiral element or the spiral elements between the operative position and the non-operative position can be also derived from the motor of the separate roller rather than from the actuating motor of the pushing plate.

As further variant, the shifting of the spiral element or elements and the shifting and, in general, of a member of separation between the input and the stack can be derived from the actuating motor of the pushing plate, while the action of the cyclical actuating mechanism can be limited to the shifting of the element of arrest from the one to the other position of dead extra-point.

What is claimed is:

1. Equipment for storing in an orderly way banknotes and/or papers and the like, for instance banknotes for an automatic machine, provided for the formation of a stack and disbursing banknotes, said equipment comprising:

at least one spiral element defining coils with an axis directed in the sense of the stacking and a terminal section adjacent to a stacking surface at an end of the stack and wherein the spiral element is rotatable around the axis and is arranged so as to receive between the coils a leading portion of the banknote, move the banknote, in consequence of the rotation, on the stacking surface, and disengaging the banknote from the coils adjacent to the terminal section, said equipment further comprising a separating roller to singularly separate the banknotes from the stack, a moving mechanism of the stack to define a condition of deposit in which the stacking surface is spaced away from the separation roller and a condition of withdrawal in which the stacking surface is in contact with the separation roller, and a shifting device for moving the spiral element between an operative position and a non-operative position, and in which, in the operative position and in the condition of deposit, the terminal section is adjacent to the stacking surface, downward of the separation roller in the sense of stacking and, in the non-operative position and the condition of withdrawal, said terminal section is upward from the stacking surface and of the separate roller, without interference with the un-stacking banknotes.

2. The equipment according to claim 1, wherein the spiral element is formed by a helical wire with a given inclination in a space of reception between the coils for the entering banknote, and in which the inclination of the coils is decreasing until a portion with substantially no inclination in correspondence of said terminal section.

3. The equipment according to claim 1, for banknote or other paper or card of height "H", said equipment being, wherein the spiral element is of cylindrical type with diameter included between 0.4H and 1.2H.

4. The equipment for storing banknotes, according to claim 1, wherein it comprises a servomechanism for the rotation of the spiral element, responsive to information of passage of the banknote to be stacked for controlling the angular phase of the spiral element so that the entering banknote has liberty of positioning with respect to the space of reception between the coils.

5. The equipment for storing banknotes according to claim 1, further comprising an arrest surface for the stack in correspondence of one of the longer edges of the banknotes, and upright position of the banknotes, and wherein the coils of the spiral element are spaced away from the arrest surface.

6. The equipment for storing banknotes according to claim 1, further comprising rollers for advancing, at the input, the banknote to be stacked and in which said rollers are on one side with respect to the surface of movement of the banknote, in proximity of the input, said equipment further comprising drawing rollers arranged with interference on an opposite side with respect to the said surface of movement, for transversely deforming the banknote in function of stiffening along the direction of introduction.

7. The equipment for storing banknotes according to claim 1, wherein it is exemplified by a box for the stacking of the banknotes, which can be mounted on the machine with possibility of removal.

8. The equipment for storing banknotes according to claim 1, in which the banknotes are stored in an upright position on longer edges thereof, and further including toothed belts for said edges and a pushing plate for the first banknote of the stack mounted on the supporting belts, wherein the stack in formation is limited in the sense of the stacking between the pushing plate and the terminal portion of the spiral element or elements, and in which the stack of banknotes is shiftable by the pushing plate and the supporting belts to leave a space of disengagement to facilitate the positioning of the banknote to be stacked on the last banknote of the stack, downward from the said terminal portion.

9. The equipment according to claim 1 characterized by the fact that the spiral element is relatively stiff.

10. The equipment for storing and delivering banknotes according to claim 1, further comprising an arrest surface for the stack in correspondence with one of the longer edges of the banknotes, and upright position of the banknotes, wherein the coils of the spiral element are spaced away from the arrest surface and in which the arrest surface is substantially horizontal and the separation roller is above the arrest surface.

11. The equipment for storing and delivering banknotes according to claim 10, further comprising a carriage of support for the spiral element and a shovel element, in which the shovel element is actuatable in synchronism with the rotation of the spiral element to push away the trailing edge of an entering and to be stacked banknote, and in which said shovel element is carried by a rotatable hub connected in the rotation with the spiral element through intermediate transmission members carried by the said carriage of support.

12. The equipment according to claim 1, further including one or more motor rollers with function of introduction and extraction of the banknotes in dependence on the sense of rotation, and in which the shifting device for the spiral element comprises a cyclical actuating mechanism having an actuating mechanism shiftable between a first position and a second position and a control member sensitive to the sense of rotation of the roller or of the motor rollers.

13. The equipment according to claim 12 wherein the moving mechanism of the stack is adapted to move positively the spiral element from the operative position to the non-operative position jointly to the shifting of the actuating mechanism between the first position and the second position, and in which said actuating mechanism is pre-set to move positively the spiral element to the operative position jointly with the shifting of the actuating mechanism between the second position and the first position.

14. The equipment according to claim 1, wherein the spiral element is yielding and is deformable by the moving mechanism of the stack in association with the change of condition between the condition of deposit and the condition of withdrawal.

15. The equipment according to claim 1, further comprising another spiral element functionally identical to said at least one spiral element, wherein the two spiral elements operate on lateral portions of the banknote to be stacked.

16. The equipment according to claim 15, wherein the two spiral elements operate in synchronism and have opposed senses of wrapping and rotation.

17. The equipment for storing banknotes according to claim 16, wherein the spiral elements are relatively stiff and the senses of rotation of the two spiral elements are pre-set to flatten the banknote jointly to the disengagement from the coils adjacent to the terminal sections.

18. The equipment according to claim 1, having an access for the input and the output of the banknotes, said equipment further comprising guide elements external to the coils of the spiral element for guiding the banknotes to be stored or to be delivered adjacent to said access.

19. Equipment for storing in an orderly way banknotes and/or papers and the like, for instance banknotes for an automatic machine, provided for the formation of a stack, said equipment comprising at least one spiral element defining coils with an axis directed in the sense of the stacking and a terminal section adjacent to a stacking surface at an end of the stack; and an arrest surface for the stack in correspondence with one of the longer edges of the banknotes, and upright position of the banknotes, in which said spiral element is rotatable around the axis and is arranged so as to receive between the coils a leading portion of the banknote, move the banknote, in consequence of the rotation, on the stacking surface, and disengaging the banknote from the coils adjacent to the terminal section, and wherein the coils of the spiral element are spaced away from the arrest surface, said equipment further comprising toothed conveying wheels slight projecting from the arrest surface, rotatable in the use and provided for urging the lower edges of the last stacked banknotes in the sense of stacking.

20. Box for the deposit and delivery of banknotes and/or papers and the like, for instance banknotes for an automatic machine, provided for the formation and the separating operations of a stack and comprising a separating roller to singularly separate the banknotes from the stack and in which a stacking surface of the stack is spaced away from the separating roller in the condition of deposit, and is in contact with the separating roller in the condition of delivery, said box further comprising:

at least one spiral element defining coils with an axis directed in the sense of stacking and a respective terminal section and configurable between an operative position and a non-operative position, and in which:

in the operative position and the condition of deposit, the terminal section is adjacent to the stacking surface and constitutes a limit and/or a support for the stack, downward from the separating roller in the sense of stacking; and in the non-operative position and in condition of delivery, the terminal section is upward from the separating roller, and does not interfere with the banknotes;

the spiral element is provided for rotation around their respective axes and being arranged so as to receive, between the coils, in the operative position and in condition of deposit, a leading portion of the incoming banknote to move the banknote, in consequence of the rotation, up to the stacking surface, with disengagement from the coils adjacent to the terminal section.

21. The box according to claim 20 for stacking banknotes in upright position on the longer edges thereof, further comprising belts of support for said edges and a pushing plate for the stack, said box being characterized by the fact that the stack is limited in the sense of the stacking between the pushing plate and the terminal portion of the spiral element and in which the stack of banknotes is shiftable under the action of the pushing plate and of the belts of support so as to leave a space of disengagement to receive a banknote to be stacked on the last stacked banknote of the stack.

22. Box for storing in an orderly way banknotes and/or papers and the like, for instance banknotes for an automatic teller machine, provided for the formation of a stack and comprising motor rollers for the introduction of the banknotes and a moving mechanism of the stack to define a condition of deposit in which a stacking surface is spaced away from the separating roller, said box comprising:

two spiral elements which define respective coils with axes directed in the sense of stacking and terminal sections with function of support for the stack, said spiral elements being rotatable around the axes and being arranged so as to receive laterally between the coils the entering banknote, and move the banknote, in consequence of the rotation, up to the stacking surface, with disengagement from the coils adjacent to the terminal sections, wherein said box is mountable, with possibility of removal, in an automatic machine comprising a respective seat, a first motor and a second motor, respectively, with a first member of output and with a second member of output, said box including moreover a first nipping member connected in the rotation with the rollers for the introduction of the banknotes and a second nipping member for the spiral elements, wherein the first nipping member and the second nipping member are respectively engageable for the motorization with the first member of output and with the second member of output of the automatic machine, upon the mounting of the box in said seat.

23. Box for storing in an orderly way banknotes and/or papers and the like, for instance banknotes for an automatic teller machine, provided for the formation of a stack and comprising:

two spiral elements which define respective coils with axes directed in the sense of stacking and terminal sections with function of support for the stack, and a separating roller to singularly separate the banknotes from the stack and which defines a condition of deposit in which the stacking surface is spaced apart from the separating roller, and a condition of withdrawal in which the stacking surface is in contact with the separating roller, said spiral elements being rotatable around the axes and being arranged so as to receive laterally between the coils the entering banknote, and move the banknote, in consequence of the rotation, up to the stacking surface, with disengagement from the coils adjacent to the terminal sections, said box further comprising a shifting device for moving the spiral elements between an operative position and a non-operative position, and in which, in the condition of deposit and in the operative position, the terminal sections are adjacent to the stacking surface, downward from the separating roller in the sense of stacking while, in the condition of withdrawal and in the non-operative position, said terminal sections are upward from the separating roller, without interference with the un-stacking banknotes.

24. Box for the deposit and the delivery of banknotes and/or papers and the like, for instance banknotes for an automatic machine, provided for the formation of a stack and for separating and delivering the banknotes from the stack, having elements of introduction/extraction of the banknotes, a separating roller to singularly separate the banknotes from the stack, a motor member for the introduction/extraction elements and the separating roller, a member of separation between the input/output area of the banknotes and a stacking surface of the stack, and in which, in a condition of deposit, the surface of stacking is spaced from the separating roller while the motor member rotates in a given sense of rotation for the introduction of the banknote and, in a condition of delivery, the stacking surface is in contact with the separate roller while the motor member rotates in opposite sense for the separation and the extraction of the banknote, the said box further comprising:

a shifting device for moving the separating roller between an operative position, downstream from the separate roller in the sense of the stacking and a non-operative position, upstream from the separate roller;

said shifting device being motorized by the motor member and comprising a cyclical actuation device with a control member sensitive to the sense of rotation of the motor member and an actuating mechanism for controlling the shifting and/or moving the member of separation according to the current condition of deposit or delivery, wherein said shifting device includes a driving gear, a driven gear of control for said actuating mechanism and a friction element for said driven gear, and in which the driven gear has a partial toothing engageble with the driving gear and a free section without toothing;

the actuating mechanism is shiftable by the driven gear between two positions of end stroke associated with terminal portions of the free section without toothing: one position of end stroke corresponding to the operative position of the member of separation , and the other position of end stroke corresponding to the non-operative position of the member of separation; and wherein said actuating mechanism is pre-set to positively operate on the carriage, with the engaging between the partial toothing and the driving gear, the friction element constantly urges said driven gear according to the sense of rotation of the driving gear to rotate the driven gear toward a first stop or toward a second stop associated respectively to the one and the other position of end stroke, and said friction element is predisposed for rotating the driven gear from the first stop or from the second stop up to the conditions of engagement of the toothing with the driving gear at the moment of the inversion of the sense of motion of the driving gear.

* * * * *